US005930562A

United States Patent [19]

Noda et al.

[11] Patent Number: 5,930,562

[45] Date of Patent: Jul. 27, 1999

[54] PROCESS CARTRIDGE AND ELECTROPHOTOGRAPHIC IMAGE FORMING APPARATUS WITH COVERED GEAR

[75] Inventors: Shinya Noda; Yoshiyuki Batori, both of Toride, Japan

[73] Assignee: Canon Kabushiki Kaisha, Tokyo, Japan

[21] Appl. No.: 08/917,902

[22] Filed: Aug. 27, 1997

[30] Foreign Application Priority Data

Aug. 30, 1996 [JP] Japan ..... 8-249203

[51] Int. Cl.[6] ..... G03G 15/00; G03G 21/18

[52] U.S. Cl. ..... 399/114; 399/167

[58] Field of Search ..... 399/111, 112, 399/113, 114, 117, 167

[56] References Cited

U.S. PATENT DOCUMENTS

| | | | |
|---|---|---|---|
| 4,591,258 | 5/1986 | Nishino et al. | 399/90 |
| 5,596,388 | 1/1997 | Ohkubo et al. | 399/111 |
| 5,729,796 | 3/1998 | Miura et al. | 399/114 |

*Primary Examiner*—Joan H. Pendegrass

*Attorney, Agent, or Firm*—Fitzpatrick, Cella, Harper & Scinto

[57] ABSTRACT

A process cartridge detachably mountable to a frame of an image forming apparatus includes an electrophotographic photosensitive drum, a process device actable on the electrophotographic photosensitive drum, a drum flange provided on an end of the electrophotographic photosensitive drum and having a gear portion, the gear portion serving to transmit a driving force acting on the process cartridge when the process cartridge is mounted to the main body of the image forming apparatus, and a cleaning frame for rotatably supporting the electrophotographic photosensitive drum. The side surfaces, the upper surface, the lower surface and the front surface of the gear potion of the drum flange in a process cartridge mounting direction are covered. The process cartridge is mounted to the main body of the image forming apparatus from a direction transverse to a longitudinal direction of the electrophotographic photosensitive drum, when the process cartridge is mounted to the frame of the image forming apparatus.

15 Claims, 10 Drawing Sheets

PROCESS CARTRIDGE AND ELECTROPHOTOGRAPHIC IMAGE FORMING APPARATUS WITH COVERED GEAR

BACKGROUND OF THE INVENTION

1. Field of the Invention

The present invention relates to a process cartridge and an electrophotographic image forming apparatus to which such a process cartridge can removably be mounted.

The "electrophotographic image forming apparatus" is an apparatus for forming an image on a recording medium by utilizing an electrophotographic image forming system and may include, for example, an electrophotographic copying machine, an electrophotographic printer (such as a laser beam printer), an electrophotographic facsimile, an electrophotographic word processor and the like. The "process cartridge" may incorporate therein an electrophotographic photosensitive member and either or both of a charge means and a cleaning means as a cartridge unit which can removably be mounted to an image forming apparatus. By using the process cartridge, since the process cartridge can be mounted on and dismounted from the image forming apparatus by the user himself, the maintenance of the apparatus can be facilitated.

2. Related Background Art

In conventional electrophotographic image forming apparatuses using an electrophotographic image forming process, a process cartridge wherein an electrophotographic photosensitive member and process means acting on the electrophotographic photosensitive member are integrally incorporated into a cartridge unit, which can removably be mounted to an image forming apparatus has been used. By using such a process cartridge, since the maintenance of the apparatus can be performed by the user himself without the help of an expert, the operability can be improved remarkably. Thus, the process cartridge has widely been used in electrophotographic image forming apparatuses.

In such a process cartridge, a driving force transmitting means is constituted by a gear train including a drum gear secured to an electrophotographic photosensitive member supported by a cartridge frame, a roller gear secured to a developing roller, a gear secured to a toner feed member and idler gears, which are meshed with each other. When the process cartridge is mounted to the image forming apparatus, the drum gear is engaged by a drive gear of the image forming apparatus, to thereby transmit a driving force of the drive gear to various elements in the process cartridge.

SUMMARY OF THE INVENTION

An object of the present invention is to provide a process cartridge and an electrophotographic image forming apparatus to which such a process cartridge can removably be mounted, in which a cartridge frame is stiffened or strengthened.

Another object of the present invention is to provide a process cartridge and an electrophotographic image forming apparatus to which such a process cartridge can removably be mounted, in which a shielding function is improved.

A further object of the present invention is to provide a process cartridge and an electrophotographic image forming apparatus to which such a process cartridge can removably be mounted, in which a protecting function, for protecting elements contained in the process cartridge, is improved.

Another object of the present invention is to provide a process cartridge and an electrophotographic image forming apparatus to which such a process cartridge can removably be mounted, in which side surfaces, an upper surface, a lower surface and a front surface of a gear portion included in a drum flange are covered.

DETAILED DESCRIPTION OF THE PREFERRED EMBODIMENTS

The present invention will now be explained in connection with embodiments thereof with reference to the accompanying drawings.

In the following explanation regarding preferred embodiments of the present invention, a "width-wise direction" of a process cartridge B is a direction along which the process cartridge B is mounted on and dismounted from a main frame 14 of an image forming apparatus A, which direction coincides with a direction perpendicular to a longitudinal direction of the image forming apparatus. A "longitudinal direction" of the process cartridge B is a direction transverse to (substantially perpendicular to) the direction along which the process cartridge B is mounted on and dismounted from the main frame 14 of the image forming apparatus, which direction is parallel to a surface of a recording medium and is transverse to (substantially perpendicular to) a recording medium conveying direction. Further, "left and right" of the process cartridge right and left sides of the recording medium looked at from the above along the recording medium conveying direction.

First Embodiment

First of all, a process cartridge according to a first embodiment of the present invention and an electrophotographic image forming apparatus to which such a process cartridge can removably be mounted will be fully described with reference to FIGS. 1 to 8.

Figure 8:
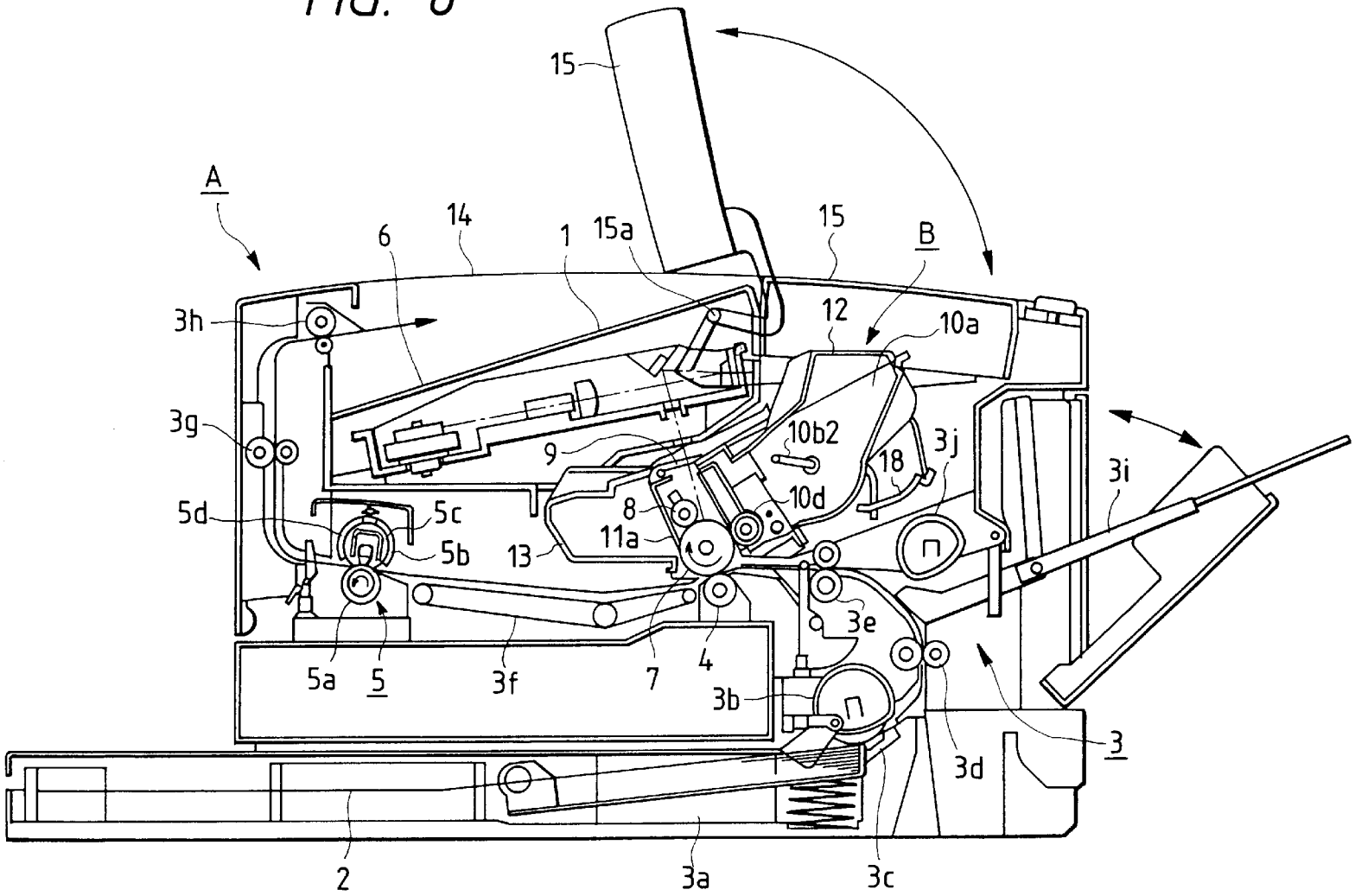
FIG. 8 is an elevational sectional view of an image forming apparatus to which a process cartridge is mounted.

As shown in FIG. 8, in the electrophotographic image forming apparatus (laser beam printer) (referred to merely as "image forming apparatus" hereinafter) A, information light, emitted from an optical system 1 in response to image information illuminates a drum-shaped electrophotographic photosensitive member to form a latent image on the photosensitive member and then the latent image is developed as a toner image. In synchronism with the formation of the toner image, a recording medium 2 is supplied from a sheet supply cassette 3*a* by a pick-up roller 3*b* and an urging member 3*c* urged against the pick-up roller, and the supplied recording medium is conveyed by a convey means (comprised of a pair of convey rollers 3*d*, a pair of regist rollers 3*e* and the like). The toner image formed on the electrophotographic photosensitive member incorporated into the process cartridge B is transferred onto the recording medium 2 by applying voltage to a transfer roller (transfer means) 4. Then, the recording medium 2 is conveyed to a fixing means 5 by a convey belt 3*f*. The fixing means 5 includes a drive roller 5*a*, and a fixing rotary member 5*d* constituted by a tube-shaped sheet rotatably supported by a support 5*c* and having a heater 5*b* therein, so that the transferred toner image is fixed onto the recording medium 2 by applying heat and pressure to the recording medium. Thereafter, the recording medium 2 is discharged onto a discharge portion 6 through a reverse rotation convey path including pairs of discharge rollers 3*g* and 3*h*. Incidentally, in the image forming apparatus A, a recording medium can be supplied manually through a manual insertion tray 3*i* and a roller 3*j*.

Figure 9:
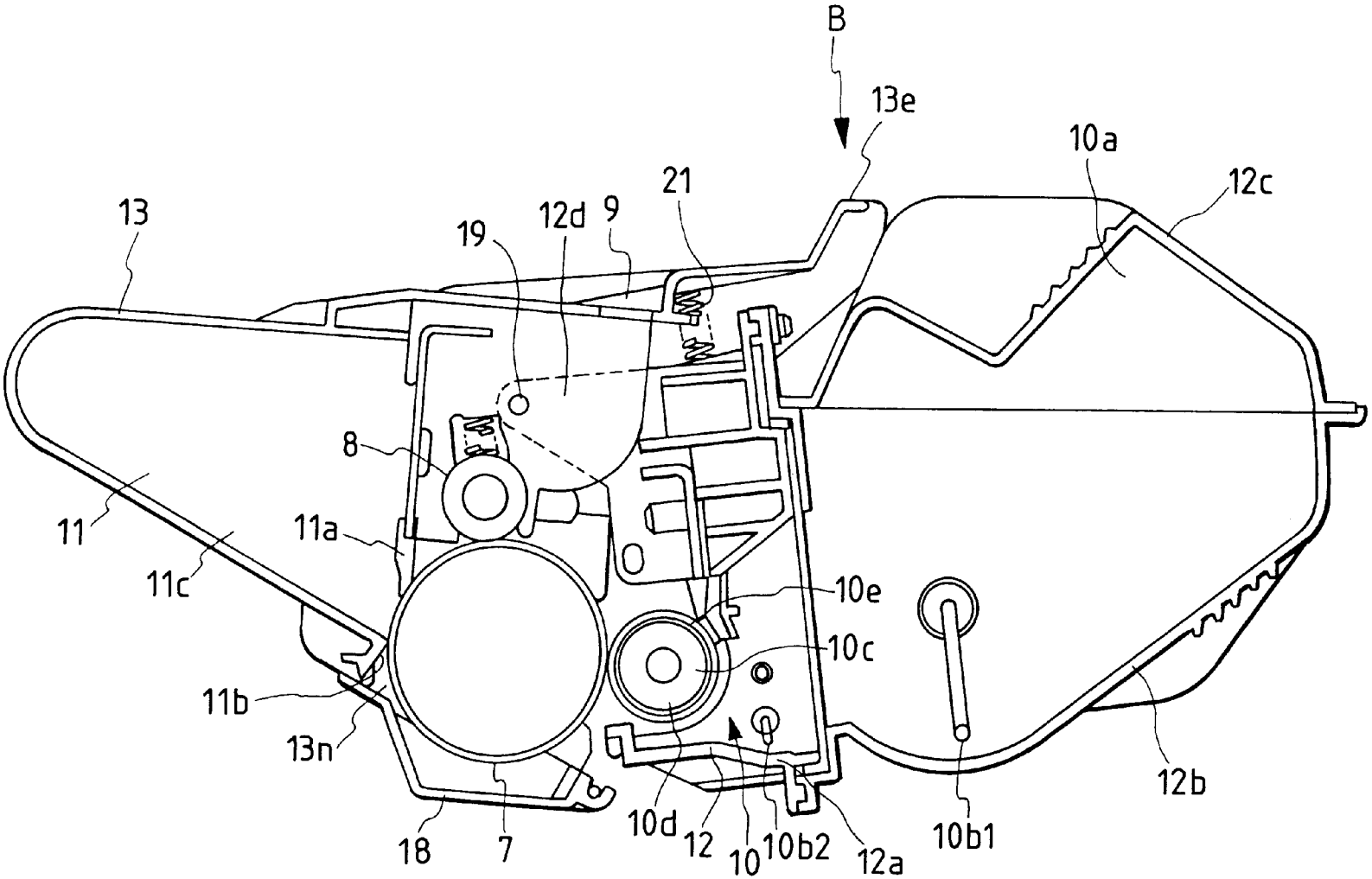
FIG. 9 is a sectional view of the process cartridge.

On the other hand, the process cartridge B includes the above-mentioned electrophotographic photosensitive member, and at least one process means. The process means may be, for example, a charge means for charging the electrophotographic photosensitive member, a developing means for developing the latent image formed on the electrophotographic photosensitive member and a cleaning means for removing residual toner remaining on the electrophotographic photosensitive member. In the process cartridge B according to the first embodiment, as shown in FIG. 9, the electrophotographic photosensitive member (photosensitive drum 7) having a photosensitive layer is rotated, a surface of the photosensitive drum 7 is uniformly charged by applying voltage to the charge means (charge roller 8), the latent image is formed by exposing the charged photosensitive drum 7 by exposing the light image from the optical system 1 through an opening portion 9, and the latent image is developed by the developing means 10.

In the developing means 10, toner contained in a toner containing portion 10*a* is fed out by a feed means (comprised of first and second rotatable feed members 10*b*1 and 10*b*2), a developing roller (developing rotary member) 10*d* containing a fixed magnet 10*c* therein is rotated, a toner layer is formed on a surface of the developing roller 10*d* by a developing blade 10*e* while applying friction charges to the toner, and the toner in the toner layer is transferred onto the latent image formed on the photosensitive drum 7, to thereby form the toner image.

After the toner image is transferred to the recording medium 2 by applying to the transfer roller 4 the voltage having a polarity opposite to that of the toner image, the residual toner remaining on the photosensitive drum 7 is removed by the cleaning means 11. That is to say, the toner remaining on the photosensitive drum 7 is scraped by a cleaning blade 11*a*, the scraped toner is received by a dip sheet 11*b*, and the received toner is collected into a waste toner reservoir 11*c*.

Incidentally, the photosensitive drum 7 and the above-mentioned process means are contained within a cartridge frame formed by interconnecting, via a pin 19, a toner developing frame 12 (obtained by integrally welding a developing frame 12*a*, a toner frame 12*b* and a lid member 12*c*) and a cleaning frame 13, as a cartridge which can removably be mounted on a cartridge mounting means provided in the frame 14 of the image forming apparatus. When the cleaning frame 13 is connected to the toner developing frame 12 by the pin 19, a compression coil spring 21 is disposed in a compressed condition between an arm portion 12*d* formed integrally with the developing frame 12*a* and a frame connecting cover portion 13*e* extending from the cleaning frame 13 above the developing frame 12*a*.

Figure 5:
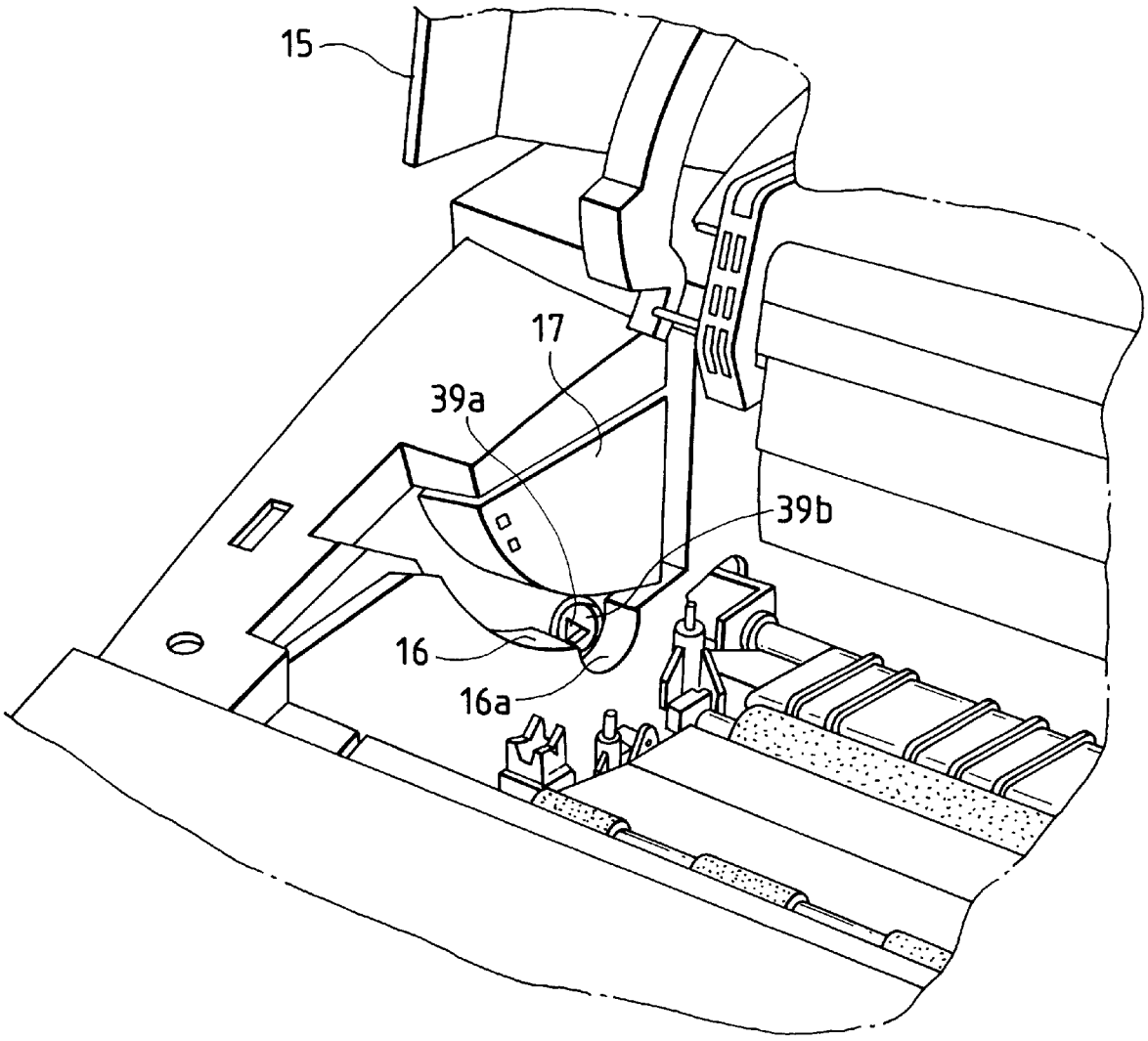
FIG. 5 is a perspective view for explaining a process cartridge mounting portion of an image forming apparatus.

The mounting and dismounting of the process cartridge B is effected after an opening/closing member 15 shown in FIG. 8 is opened. When the opening/closing member 15 is opened, the cartridge mounting means is exposed. As shown in FIG. 5, the cartridge mounting means includes a pair of left and right opposed cartridge mounting guide members 17 provided on a left and a right side surface of the apparatus frame 14, and guide grooves 16 acting as guides for guiding insertion of the process cartridge B are formed in the left and right guide members 17 (while the right guide member and its groove are not shown, they have the same configuration as the left guide member and its groove). After bosses 38*a* (FIG. 10) protruded from both longitudinal side surfaces of the process cartridge B are inserted into the guide grooves 16 until the bosses 38*a* are positioned in recesses 16*a* of the guide grooves 16, when the opening/closing member 15 is closed, the mounting of the process cartridge B to the image forming apparatus A is completed.

Next, a coupling means as a driving force transmitting mechanism for transmitting a driving force from the image forming apparatus A to the process cartridge B will be explained with reference to FIGS. 3 and 4.

Figure 3:
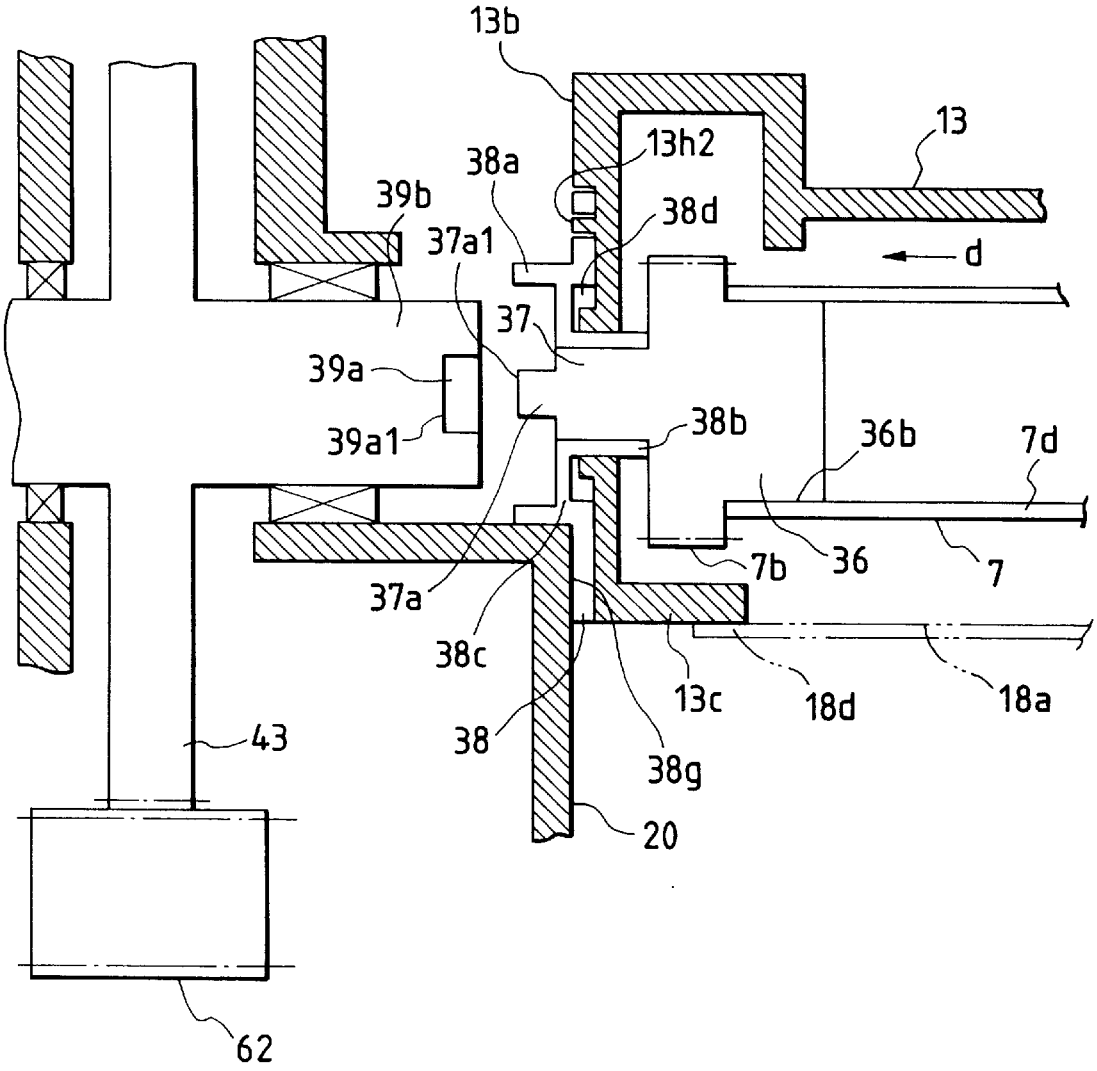
FIG. 3 is a partial longitudinal sectional view for explaining the first embodiment.
Figure 4:
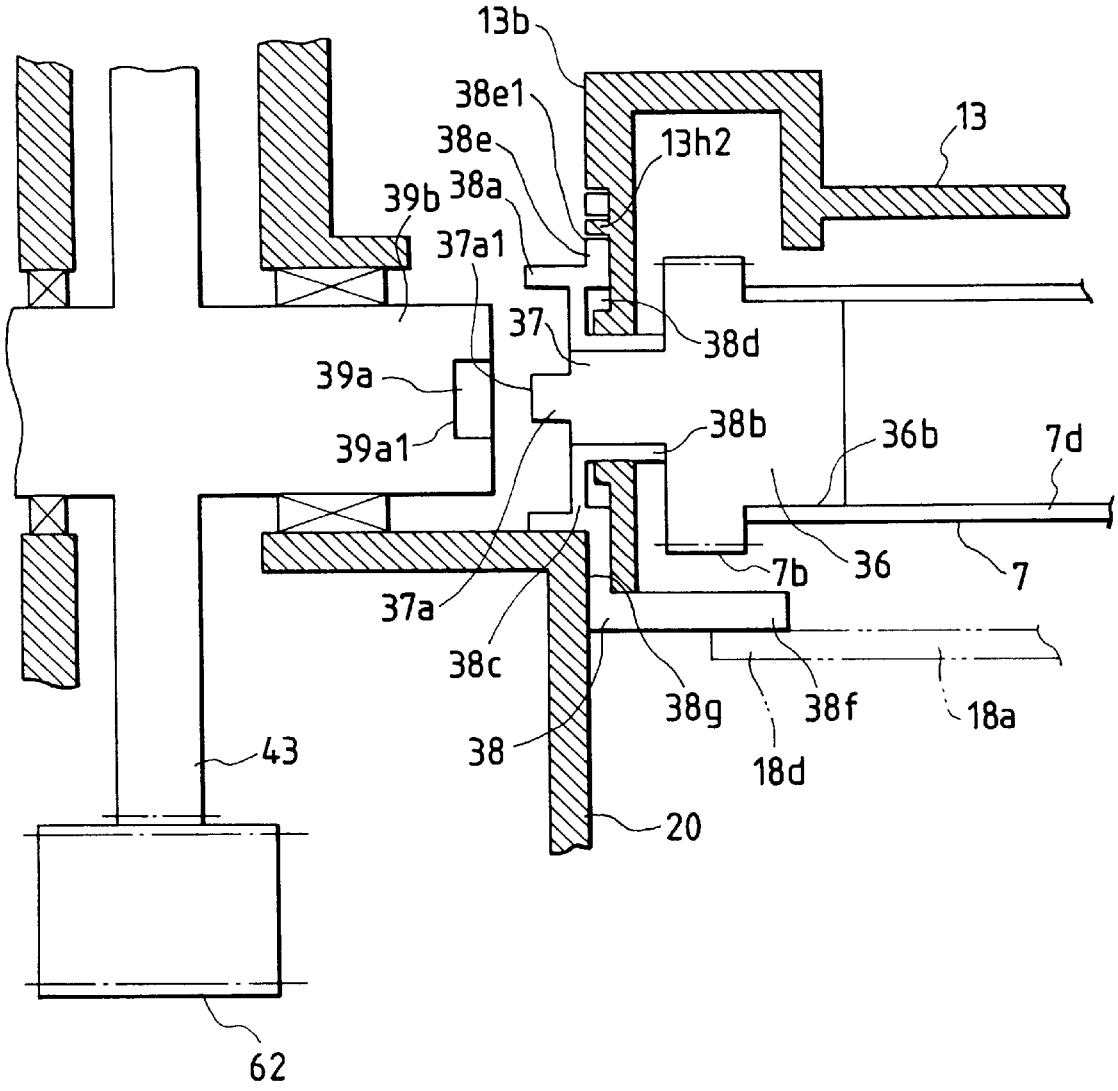
FIG. 4 is a partial longitudinal sectional view for explaining a second embodiment of the present invention.

FIG. 3 is a sectional view of the coupling means in a condition that the photosensitive drum 7 is attached to the process cartridge B. Since FIG. 3 shows a condition that the process cartridge B is mounted on the frame 14 of the image forming apparatus, a drum shutter 18 is opened. However, for convenience's sake for explanation, a shutter cover 18*a* and its extension portion 18*d* positioned when the drum shutter 18 is in a closed position are shown by the two dot and chain lines in FIG. 3.

A cartridge side coupling means is provided on one of the longitudinal ends of the photosensitive drum 7 attached to the process cartridge B. This coupling means includes a (cylindrical) coupling protrusion shaft 37 provided on a drum flange 36 secured to the one end of the photosensitive drum 7, which protrusion shaft is provided at its tip end with a projection 37*a* having an end face parallel to an end face of the protrusion shaft 37. The protrusion shaft 37 is fitted in a bearing portion 38*b* of a bearing 38 to act as a drum rotational shaft. The coupling protrusion shaft 37 and the projection 37*a* are formed integrally with the drum flange 36. The drum flange 36 is provided with an integral helical drum gear 7*b* meshed with a developing roller gear 10*f* (FIG. 1) secured to and coaxial with the developing roller 10*d* in the process cartridge B. Accordingly, as shown in FIG. 3, the drum flange 36 is formed as an integral part including the drum gear 7*b*, the protrusion shaft 37 and projection 37*a* and has a function for transmitting a driving force.

The projection 37*a* has a twisted polygonal post (i.e., a post having triangular cross-section and gradually twisted in a rotational direction along an axial direction). Thus, a recessed portion 39*a* to be fitted on the projection 37*a* has a hole having a polygonal cross-section (substantially triangular cross-section) and gradually twisted in a rotational direction along an axial direction. The projection 37*a* and the recessed portion 39*a* have the same twisted pitch and twisted direction. The recessed portion 39*a* is provided in a coupling recessed shaft 39*b* integrally formed with a large gear 43 disposed in the frame 14 of the image forming apparatus, which recessed shaft is rotatable and shiftable in an axial direction.

After the process cartridge B is mounted to the frame 14 of the image forming apparatus to fit the projection 37*a* into the recessed portion 39*a*, when a rotational force is transmitted from the recessed portion 39*a* to the projection 37*a*, since the outer surface of the substantially triangular projection 39*a* uniformly contacts the inner surface of the recessed portion 39*a*, the axis of the projection is aligned with the axis of the recessed portion. Thus, a diameter of a circumscribed circle of the coupling protrusion portion 37*a* is selected to be greater than a diameter of an inscribed circle of the coupling recessed portion 39*a* and to be smaller than a diameter of a circumscribed circle of the coupling recessed portion 39*a*. Further, due to the twisted configuration, the recessed portion 39*a* pulls the projection 37*a* to abut an end face 37*a*1 of the projection against a bottom 39*a*1 of the recessed portion. Since a thrust force produced in the coupling portion and the drum gear 7*b* acts in a direction shown by the arrow d, axial and radial positions of the photosensitive drum 7 integral with the projection 37*a* are correctly positioned within the frame 14 of the image forming apparatus.

The protrusion shaft 37 and the projection 37*a* are provided on the drum flange 36 so that they become coaxial with the axis of the photosensitive drum 7 when the drum flange 36 is attached to one end of the photosensitive drum 7. Incidentally, when the drum flange 36 is attached to the photosensitive drum 7 by caulking or adhesive, a fitting portion 36*b* is fitted into a drum cylinder 7*d*.

A photosensitive layer is coated on the drum cylinder 7*d*. The drum flange 36 may be made of resin material such as polyacetal, polycarbonate, polyamide or polybutylene terephthalate, but may be formed from other appropriate materials.

Around the projection 37*a* of the coupling protrusion portion 37 of the process cartridge B, there is provided a cylindrical boss 38*a* (coaxial with the protrusion portion 37) formed integrally with the bearing 38 secured to the cleaning frame 13. The cylindrical hollow boss 38*a* surrounds the projection 37*a* so that the projection 37*a* of the coupling protrusion portion 37 is protected when the process cartridge B is mounted on and dismounted from the image forming apparatus, to thereby prevent damage and deformation of the projection due to an external force and prevent play and vibration during the operation of the coupling.

On the other hand, the frame 14 of the image forming apparatus includes an apparatus side coupling means. This coupling means comprises a (cylindrical) coupling recessed shaft 39*b* (FIGS. 5 and 6) disposed at a position aligned with the axis of the photosensitive drum when the process cartridge B is inserted. As shown in FIG. 3, the coupling recessed shaft 39*b* is integral with a large gear 43 for transmitting a driving force of a motor to the photosensitive drum 7 and protrudes from a side surface of the large gear 43 coaxial with the latter (see FIGS. 3 and 6). In the illustrated embodiment, the coupling recessed shaft 39*b* is formed integrally with the large gear 43.

Figure 6:
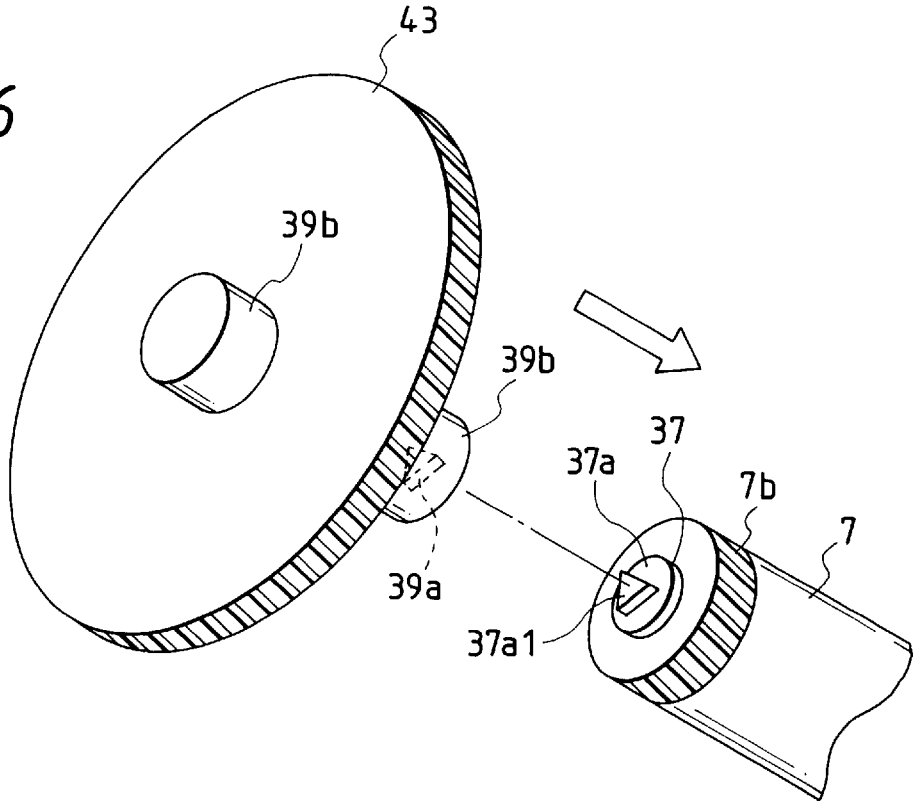
FIG. 6 is an exploded perspective view for explaining a driving force transmitting mechanism.
Figure 7:
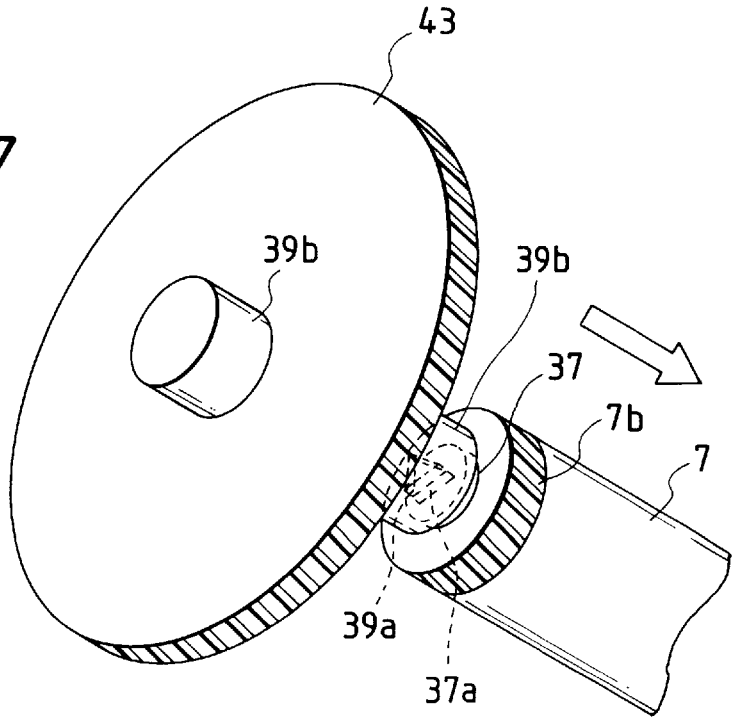
FIG. 7 is a perspective view for explaining the driving force transmitting mechanism.

The large gear 43 of the image forming apparatus is a helical gear meshed with a small helical gear 62 and includes helical direction and inclined-angle teeth so that, a driving force is transmitted from the small gear 62 to the large gear, and a thrust force for shifting the recessed shaft 39*b* toward the protrusion shaft 37 is generated. With this arrangement, as shown in FIGS. 6 and 7, when the motor is driven for image formation, the recessed shaft 39*b* is shifted toward the protrusion shaft 37 by the thrust force, to thereby engage the recessed portion 39*a* (formed in the end surface of the recessed shaft 39*b* in coaxial with the latter) by the projection 37*a*.

In this way, the above-mentioned process cartridge has the following construction. That is to say, there is provided "a process cartridge B detachably mountable to a main assembly 14 of an image forming apparatus, wherein the main assembly 14 includes a motor (not shown), a main assembly side gear 43 for receiving a driving force from the motor and a hole 39*a* defined by twisted surfaces, the hole 39*a* being substantially coaxial with the gear, the process cartridge comprising:

an electrophotographic photosensitive drum 7;

process means 8, 10, 11 actable on the photosensitive drum 7; and a twisted projection 37*a* engageable with the twisted surfaces, the projection 37*a* being provided at a longitudinal end of the photosensitive drum 7, wherein when the main assembly side gear 43 rotates with the hole 39*a* and projection 37*a* engage with each other, a rotational driving force is transmitted from the gear 43 to the photosensitive drum 7 through engagement between the hole 39*a* and the projection 37*a*."

Incidentally, in the illustrated embodiment, while an example that the driving force is directly transmitted from the small gear 62 associated with the motor shaft to the large gear 43 was explained, the driving force may be transmitted to the large gear with speed reduction by using a gear train, a belt and pulleys, a pair of friction rollers, or a timing belt and pulleys.

Next, attachment of the bearing to the cleaning frame 13 and attachment of the photosensitive drum 7 in the cartridge unit to the cleaning frame 7 will be concretely explained with reference to FIG. 2, which is a perspective view showing an attachment relation between the bearing 38 and the cleaning frame 13.

Figure 1:
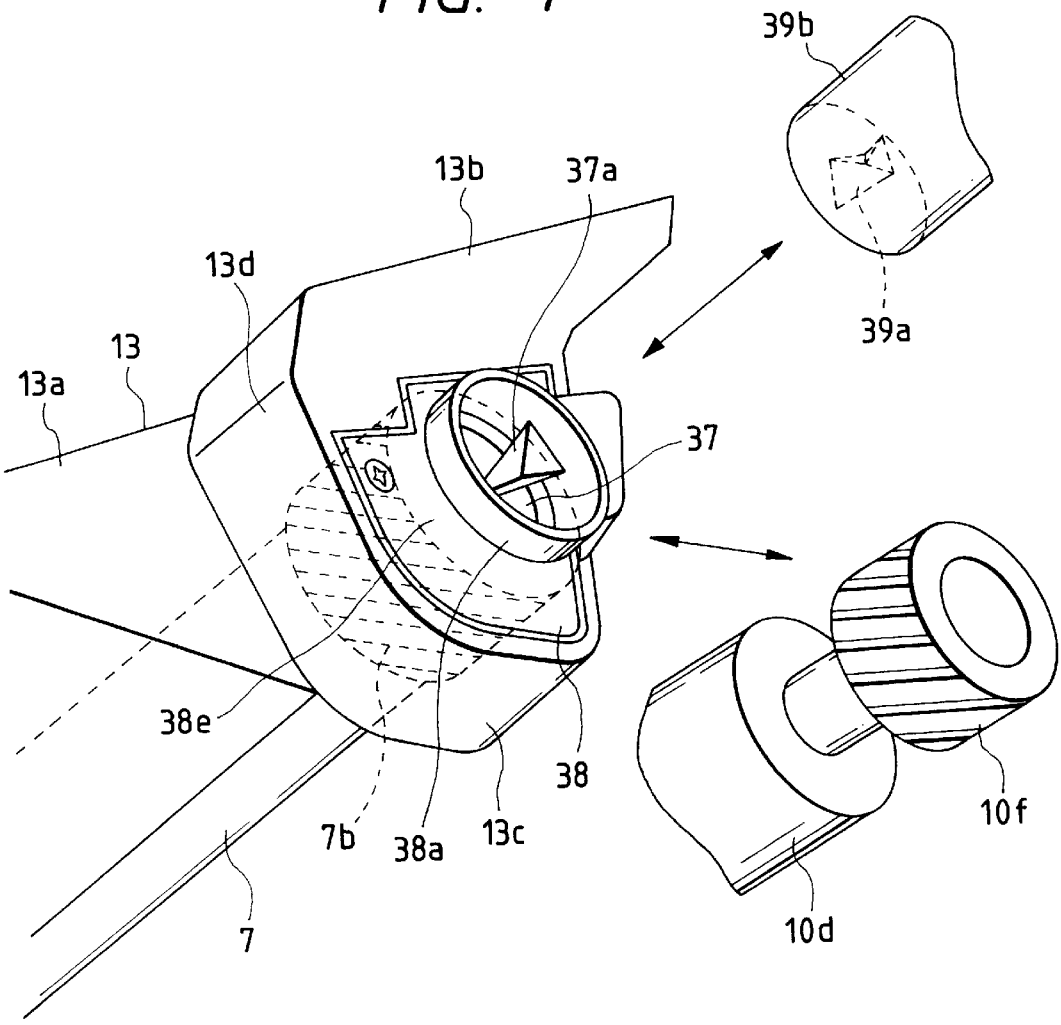
FIGS. 1 and 2 are exploded perspective views for explaining a first embodiment of the present invention.
Figure 2:
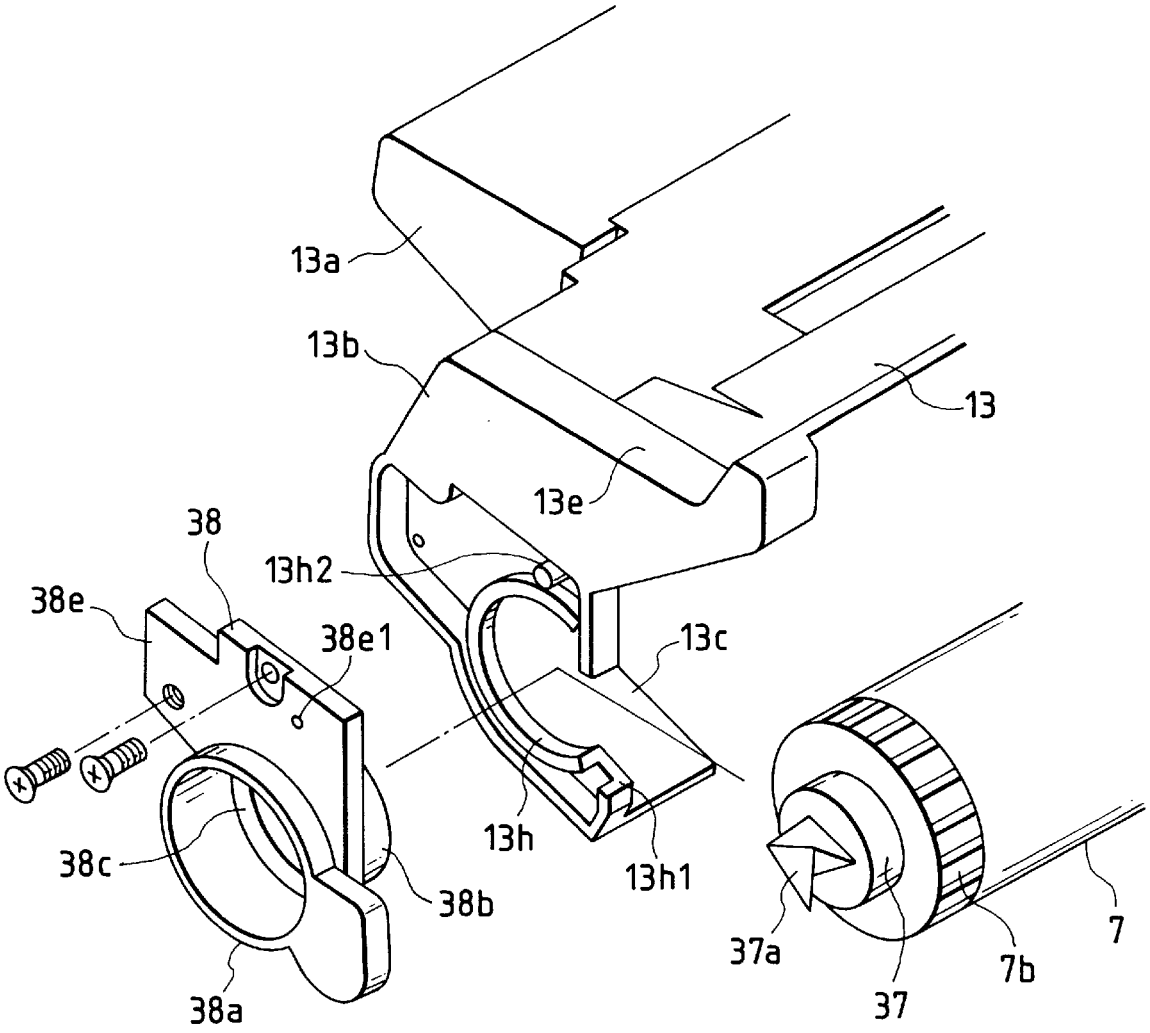

As shown in FIGS. 1 to 3, a bearing portion 38*b* having a smaller diameter than that of the boss (referred to as "cylindrical guide" when used as a cylindrical guide) 38*a* and being coaxial with the boss is integrally formed on a rear surface of the bearing 38. The bearing portion 38*b* is connected, at its one end, to the cylindrical guide 38*a* via a disk portion 38*c* connected to an intermediate (in the longitudinal direction) portion of the cylindrical guide. An annular space 38*d* is defined between the bearing portion 38*b*/cylindrical guide 38*a* and the cleaning frame 13.

As shown in FIG. 2, a semi-circular bearing attachment hole 13*h* is formed in a side wall 13*b* of the cleaning frame 13, and a cut-away portion 13*h*1 has a spaced distance smaller than a diameter of the bearing attachment hole 13*h* and greater than a diameter of the coupling protrusion shaft 37. Since the coupling protrusion shaft 37 is fitted into the bearing portion 38*b* of the bearing 38, there is created a space between the coupling protrusion shaft 37 and the bearing attachment hole 13*h*. A positioning pin 13*h*2 integrally formed with the side wall 13*b* of the cleaning frame 13 is adapted to be closely fitted into a hole 38*e*1 formed in a flange portion 38*e* of the bearing 38. Thus, the photosensitive drum 7 in the cartridge unit can be attached to the cleaning frame 13 from a direction transverse to the axial direction (longitudinal direction), and a positional relation of the bearing 38 with respect to the cleaning frame 13 is correctly determined when the bearing 38 is attached to the cleaning frame 13 along the longitudinal direction.

In order to attach the photosensitive drum 7 in the cartridge unit to the cleaning frame 13, as shown in FIG. 2, the photosensitive drum 7 is shifted in a direction transverse to the longitudinal direction, and the coupling protrusion shaft 37 is inserted into the bearing attachment hole 13*h* through the cut-away portion 13*h*1 with the drum gear 7*b* being disposed in the cleaning frame 13. In this condition, the bearing 38 is shifted in the axial direction to fit the bearing portion 38*b* onto the coupling protrusion shaft 37, and is further shifted in the axial direction to fit the bearing portion 38*b* into the bearing attachment hole 13*h* of the cleaning frame 13.

By using the above-mentioned driving force transmitting mechanism, a space or opening portion in which a drum gear is engaged by a drive gear of an image forming apparatus, which space was inevitably required in the conventional techniques, can be eliminated. As a result, as shown in FIGS. 1 and 2, guard portions 13*c* for covering the drum gear 7*b* are provided below the side walls 13*b* suspended from both longitudinal ends of a cover portion 13*e* of the cleaning frame 13 by which the photosensitive drum 7 is rotatably supported. The guard portions 13*c* are connected to the side walls 13*b* of the cleaning frame 13, and, as shown in FIG. 1, are also connected to front connection portions 13*d* for connecting the side walls 13*b* to side plates 13*a* of a waste toner reservoir portion 11*c* (the front connection portions 13*d* are front wall portions looked at from a mounting direction of the process cartridge B to the frame 14 of the image forming apparatus). Thus, the side walls 13*b* of the cleaning frame 13 are connected at three sides, i.e., front, upper and lower sides (looked at from the mounting direction of the process cartridge B to the frame 14 of the image forming apparatus) to form an integral cover member, to thereby increase rigidity of the bearing 38 for rotatably supporting the photosensitive drum 7.

Further, as shown in FIG. 3, since the coupling projection 37*a* and the coupling recessed portion 39*a* (which constitute the driving force transmitting members) have a twisted configuration, a force for pulling the projection 37*a* provided on the drum flange 36 toward the coupling recessed portion 39*a* is generated in the direction shown by the arrow d, which force acts as a biasing force for abutting the side wall 13*b* of the cleaning frame 13 against an inner wall 20 of the frame 14 of the image forming apparatus. However, since the rigidity of the side wall 13*b* of the cleaning frame 13 on which the guard portion 13*c* is formed is increased, the side wall 13*b* is prevented from being deformed by the biasing force. As a result, the rotational axis of the photosensitive drum is prevented from being slightly deviated to stabilize the rotation of the photosensitive drum 7 and the rigidity of the side wall 13*b* of the cleaning frame 13 to which the bearing 38 having the cylindrical guide 38*a* is increased, to improve the positioning accuracy of the process cartridge B with respect to the frame 14 of the image forming apparatus.

Further, since the guard portion 13*c* covers the lower portion of the drum gear 7*b*, if a sheet jam occurs, to remove the jammed recording medium, when the process cartridge B is dismounted from the frame 14 of the image forming apparatus and is rested on a desk and the like, the drum gear 7*b* can be protected by the guard portion.

Figure 10:
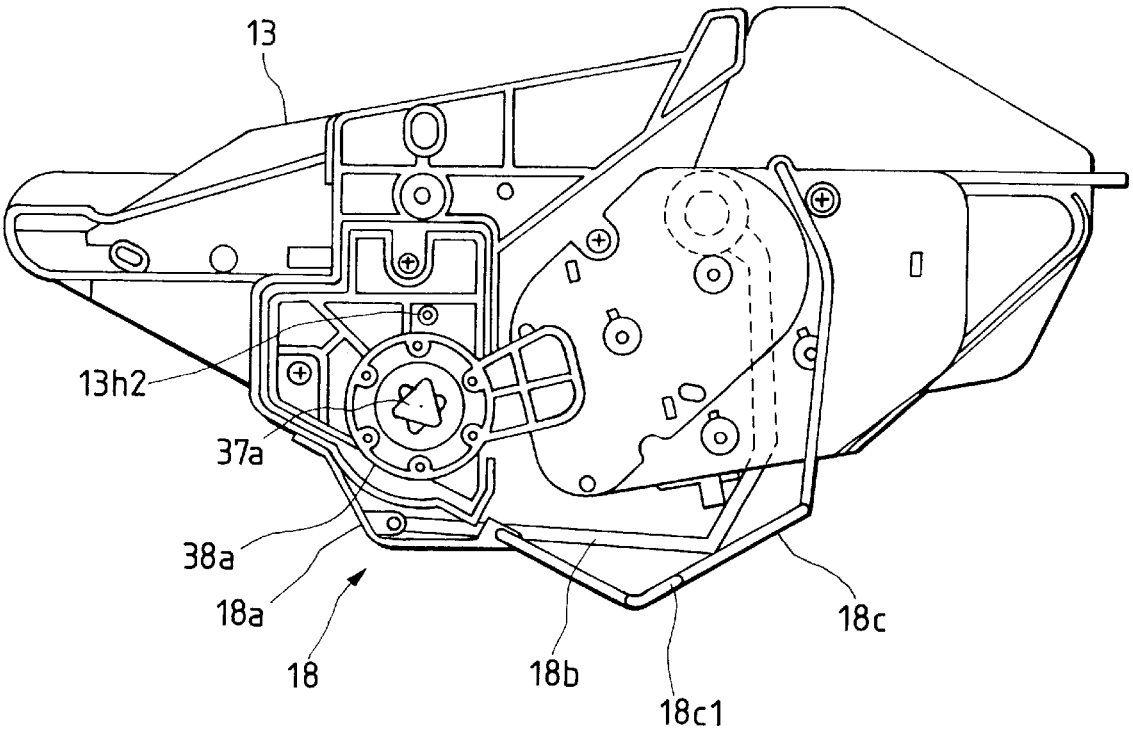
FIG. 10 is a side view of the process cartridge.
Figure 11:
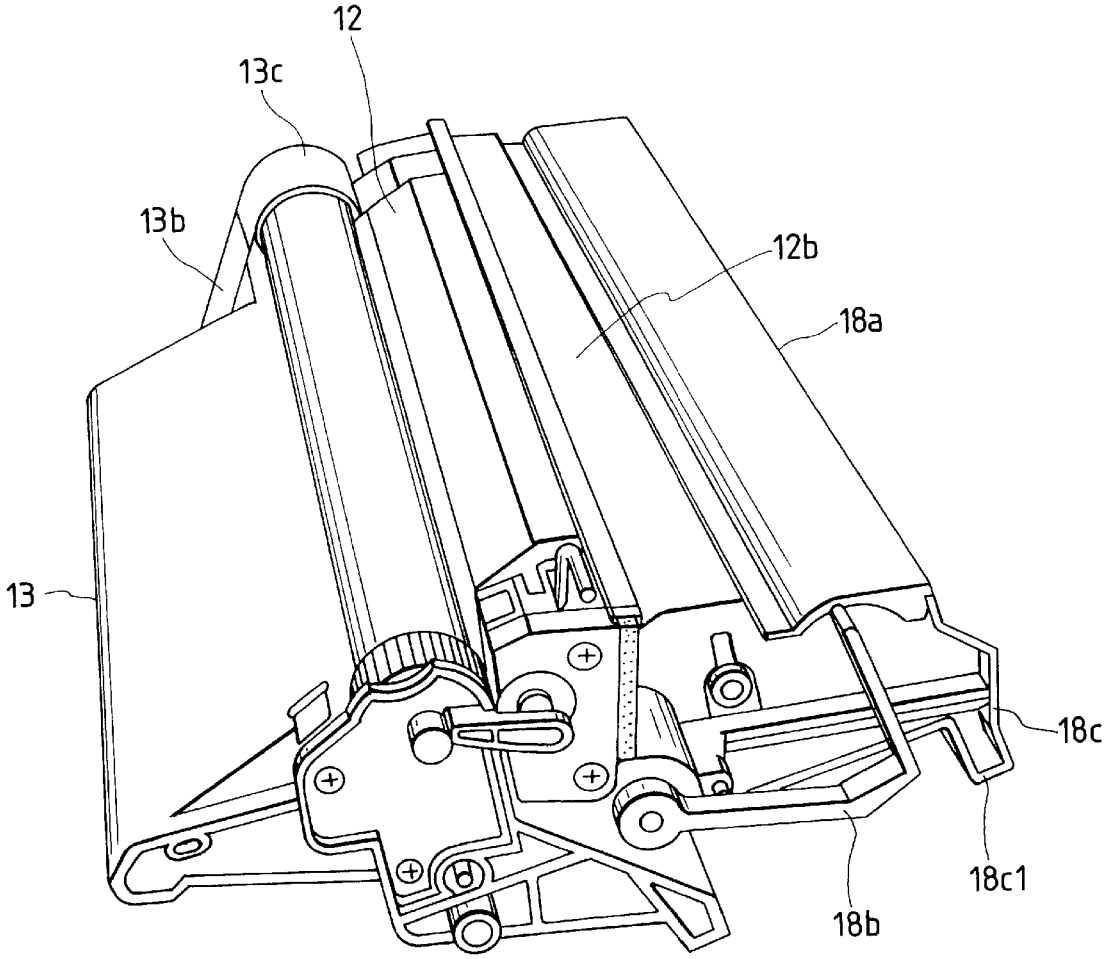
FIG. 11 is a perspective view of the process cartridge showing a lower surface thereof.

A drum shutter is provided for protecting the photosensitive drum 7 when the process cartridge B is dismounted from the frame 14 of the image forming apparatus. That is to say, as shown in FIGS. 9 to 11, a drum shutter 18 is constituted as a quadric link mechanism including a shutter cover 18*a* for covering a transfer opening portion 13*n*, two links 18*b*, 18*c* for supporting the shutter cover 18*a*, and a link constituted by a portion of the cartridge frame. As the process cartridge B is inserted, a protruded portion 18*c*1 protruding outwardly from the link 18*c* in the longitudinal direction is caught by a member (not shown) provided on the apparatus frame 14, so that the shutter cover 18*a* is shifted from a first position (FIG. 10) where the transfer opening portion 13*n* is covered by the shutter cover to a second position (FIGS. 8 and 11) where the shutter cover is retarded from the transfer opening portion 13*n*. As a result, the photosensitive drum 7 is opposed to the transfer roller 4 and the light from the optical system 1 can reach the photosensitive drum 7. As shown in FIG. 3, when the process cartridge B is dismounted from the frame 14 of the image forming apparatus and the shutter cover 18*a* is shifted to the first position, an extension 18*d* provided on a longitudinal end of the shutter cover 18*a* is overlapped with the guard portion 13*c* of the side wall 13*b* of the cleaning frame 13 from outside (shown by the two dot and chain line in FIGS. 3 and 4). Consequently, even when the process cartridge B is dismounted from the frame 14 of the image forming apparatus and is rested on a desk and the like, the shutter cover 18*a* does not contact the photosensitive drum 7, to thereby prevent damage to the photosensitive drum.

If toner leaks from a toner container in the vicinity of the guard portion 13*c*, such toner is accumulated in a space defined by the guard portion 13*c*, side wall 13*b* and front connection portion 13*d*, to thereby prevent the toner from scattering within the frame 14 of the image forming apparatus to protect the apparatus frame 14.

Now, the guard portion 13*c* will be described in more detail. The guard portion 13*c* is provided on the lower end of the side wall 13*b* of the cleaning frame 13 to cover the drum gear 7*b* and is connected to the front connection portion 13*d* connecting the side wall 13*b* to a side wall 13*a* of the waste toner reservoir 11*c*. An inner surface of the guard portion 13*c* is spaced apart from a tip circle of the drum gear 7*b* by a distance of about 1 mm or more so that the drum gear is prevented from being damaged even if the guard portion 13*c* is deformed by any shock. Further, the guard portion 13*c* may be configured so that the guard portion becomes parallel or is slightly flared with respect to an injection mold not to create any under-cut during injection molding of the cleaning frame 13. By adopting such a configuration of the guard portion, since a slide mechanism associated with the injection mold can be omitted, the cost of the injection mold can be minimized and the service life of the injection mold can be increased. Even when such configuration of the guard portion is adopted, the operability for attaching the photosensitive drum 7 to the cleaning frame 13 is not worsened.

Second Embodiment

In the above-mentioned first embodiment, an example that the guard portion 13*c* for protecting the drum gear 7*b* is formed integrally with the side wall 13*b* of the cleaning frame 13 was explained. To the contrary, in a second embodiment of the present invention, as shown in FIG. 4, a guard portion 38*f* is provided on the bearing 38 for supporting the photosensitive drum 7, and the guard portion 38*f* abuts against or is overlapped with a front connection cover portion 13*d* provided on the cleaning frame 13. Further, an abutment portion 38*g* for abutting against the inner wall 20 of the frame 14 of the image forming apparatus is provided on the bearing 38.

With this arrangement, similar to the first embodiment, the following advantages can be obtained.

(1) The drum gear 7*b* can be protected.

(2) The side wall 13*b* can be prevented from being deformed due to the axial biasing force of the helical drum gear 7*b*, to thereby improve the positioning accuracy of the process cartridge B within the frame 14 of the image forming apparatus.

(3) The shutter cover 18*a* of the drum shutter 18 acts as the longitudinal abutting or contacting portion. Thus, the peripheral portion and end portions of the photosensitive drum 7 are covered more completely.

(4) An accumulating portion for the leaking toner can be provided.

Since the bearing 38 is an element for positioning the photosensitive drum 7 at a predetermined position after the unit including the photosensitive drum 7 having the drum flange 36 is attached to the cleaning frame 13, the guard portion 38*f* integral with the bearing 38 can be extended near a meshing area between the drum gear 7*b* and the developing roller gear 10*f*. With this arrangement, the protecting function of the guard portion 38*f* for protecting the drum gear 7*b* is improved.

According to the first and second embodiments of the present invention, since the gear portion of the drum flange is not disposed to the outside and is protected from foreign matter and damage, the good image can always be obtained. Further, since the rigidity of the side walls for rotatably supporting the electrophotographic photosensitive drum is increased, the flexion of the side walls is minimized, to thereby improve the positioning accuracy of the electrophotographic photosensitive drum. If the toner is leaking from the process cartridge, since the toner is accumulated on the surface of the cover member, the toner can be prevented from scattering within the frame of the image forming apparatus.

Further, according to the first and second embodiments of the present invention, the gear portion of the drum flange can easily be covered.

According to the first and second embodiments of the present invention, since the bearing attaching portion has the notched portion (cut-out portion) and its rigidity is increased by the walls defining the front, side, upper and lower surfaces, the assembling ability of the bearing attaching portion is improved and the rigidity of the walls for rotatably supporting the electrophotographic photosensitive drum can be increased.

According to the first and second embodiments of the present invention, since the drum shutter is provided at its end with the extension extending in the axial direction of the electrophotographic photosensitive drum, the entire electrophotographic photosensitive drum and the gear portion of the drum flange can be protected. Further, foreign matter such as dirt can be prevented from entering around the photosensitive drum through between the lower cover portion and the drum shutter. Thus, the electrophotographic photosensitive drum is completely protected.

Further, according to the first and second embodiments of the present invention, since the rigidity of the attaching portion of the cylindrical guide is increased, the process cartridge can be mounted to the frame of the image forming apparatus with high accuracy.

As mentioned above, according to the present invention, the gear portion can be protected.

What is claimed is:

1. A process cartridge removably mounted to a main body of an image forming apparatus, comprising:

an electrophotographic photosensitive drum;

process means actable on said electrophotographic photosensitive drum;

a drum flange provided on a side end of said electrophotographic photosensitive drum and having a gear portion, said gear portion serving to transmit a driving force acting on the process cartridge when the process cartridge is mounted to said main body of the image forming apparatus; and a cleaning frame for rotatably supporting said electrophotographic photosensitive drum;

wherein side surfaces, an upper surface, a lower surface, and a front surface of said gear portion of said drum flanges in a process-cartridge-mounting direction facing corresponding directions when the process cartridge is mounted on the main body, are covered; and wherein the process cartridge is mounted to said main body of the image forming apparatus from a direction transverse to a longitudinal direction of said electrophotographic photosensitive drum.

2. A process cartridge according to claim 1, wherein said drum flange of the process cartridge includes a rotary support portion provided coaxial with an axis of said electrophotographic photosensitive drum and a driving force receiving portion provided coaxial with the axis of said electrophotographic photosensitive drum, in addition to said gear portion, said driving force receiving portion serving to receive a driving force for rotating said electrophotographic photosensitive drum from said main body of the image forming apparatus when the process cartridge is mounted thereon, and further comprising a bearing member having a bearing portion for fitting on said rotary support portion of said drum flange and secured to said cleaning frame.

3. A process cartridge according to claim 2, wherein said rotary support portion has a cylindrical protruded shaft, and said cleaning frame incudes a cut-out portion having an open end of a width slightly greater than an outer diameter of said protruded shaft and a bearing member attaching portion of a diameter greater than the width of said cut-out portion contiguous to said cut-out portion, so that said bearing member is attached to said bearing member attaching portion.

4. A process cartridge according to claim 1, wherein said side surfaces, upper surface, lower surface and front surface of said gear portion of said drum flange in the process-cartridge-mounting direction are covered by a cover portion integral with said cleaning frame.

5. A process cartridge according to claim 1, wherein said side surfaces, upper surface and front surface of said gear portion of said drum flange in the process-cartridge-mounting direction are covered by a cover portion integral with said cleaning frame, and said lower surface of said gear portion of said drum flange is covered by a cover portion of a bearing member.

6. A process cartridge according to claim 4 or 5, further comprising a drum shutter shifted to a first position for covering said electrophotographic photosensitive drum when the process cartridge is dismounted from said main body of the image forming apparatus and a second position retarding from said first position toward the interior of said main body of the image forming apparatus as the process cartridge is mounted to said main body of the image forming apparatus, wherein said drum shutter is provided at its longitudinal end with an extension extending in an axial direction of said electrophotographic photosensitive drum to be contacted with an outer surface of said cover portion for covering the lower surface of said gear portion of said drum flange when said drum shutter is in said first position.

7. A process cartridge according to claim 2 or 3, wherein said bearing member includes a bearing hole and a cylindrical guide protruded axially outwardly coaxial with said bearing hole, and said guide is fitted in a groove provided in a cartridge mounting portion when the process cartridge is mounted to said cartridge mounting portion of said main body of the image forming apparatus.

8. A process cartridge according to claim 6, wherein, in the contact area between said cover portion and said drum shutter, said extension of said drum shutter is overlapped with said cover portion.

9. A process cartridge according to claim 1, wherein said process means includes developing means for developing a latent image formed on said electrophotographic photosensitive drum, and said gear portion transmits a driving force for driving said developing means to said developing means.

10. A process cartridge according to claim 1, wherein said process means includes at least one of a charge means for charging said electrophotographic photosensitive drum, a developing means for developing a latent image formed on said electrophotographic photosensitive drum, and a cleaning means for removing residual toner remaining on said electrophotographic photosensitive drum.

11. A process cartridge according to claim 2, wherein said main body of the image forming apparatus includes a motor, a frame side gear for receiving a driving force from said motor and a hole defined by twisted surfaces to be substantially coaxial with said gear, said process cartridge comprising:

an electrophotographic photosensitive drum; and process means actable on said photosensitive drum;

wherein said driving force receiving portion includes a twisted projection engageable with said twisted surfaces, said projection being provided at a longitudinal end of said photosensitive drum, and when said frame side gear rotates with said hole and projection engaged with each other, a rotational driving force is transmitted from said gear to said photosensitive drum through engagement between said hole and said projection.

12. An electrophotographic image forming apparatus to which a process cartridge can removably mounted to form an image on a recording medium, comprising:

(a) mounting means capable of detachably mounting a process cartridge including an electrophotographic photosensitive drum, process means actable on said electrophotographic photosensitive drum, a drum flange provided on a side end of said electrophotographic photosensitive drum and having a gear portion, said gear portion serving to transmit a driving force acting on the process cartridge when the process cartridge is mounted to said main body of the image forming apparatus, and a cleaning frame for rotatably supporting said electrophotographic photosensitive drum, wherein side surfaces, an upper surface, a lower surface and a front surface of said gear portion of said drum flanges, in a process cartridge mounting direction facing corresponding directions when the process cartridge is mounted to said main body of the image forming apparatus, are covered, and wherein the process cartridge is mounted to said main body of the image forming apparatus from a direction transverse to a longitudinal direction of said electrophotographic photosensitive drum; and (b) convey means for conveying the recording medium.

13. A process cartridge removably mounted to a main body of an image forming apparatus having a frame in which is disposed a driven gear, a rotatable and shiftable coupling recessed shaft integral with the driven gear and including a recessed portion, said process cartridge comprising:

a cleaning frame;

a toner developing frame supporting a developer comprising a toner containing portion, a developing roller holding a toner layer of toner from said toner containing portion, and a developing roller gear secured to and coaxial with said developing roller, wherein said cleaning frame and said toner developing frame are connected to each other;

an electrophotographic photosensitive drum supported by said cleaning frame and receiving toner from the toner layer held by said developing roller;

process means actable on said electrophotographic photosensitive drum;

a driving force transmitting mechanism for transmitting a driving force from the image forming apparatus to said process cartridge, comprising:

cartridge side coupling means provided on one of the longitudinal ends of said electrophotographic photosensitive drum comprising:

a drum flange secured to the one longitudinal end of said electrophotographic photosensitive drum;

a coupling protrusion shaft provided on said drum flange comprising a projection at the tip end of said coupling protrusion shaft, said projection having an end face parallel to an end face of said coupling protrusion shaft and having a twisted polygonal post having the same twisted pitch and twisted direction as the recessed portion of the recessed shaft of the image forming apparatus, wherein the diameter of a circumscribed circle of said projection is greater than the diameter of an inscribed circle of the recessed portion and is smaller than the diameter of a circumscribed circle of the recessed portion, wherein the recessed portion fits over said projection when said process cartridge is mounted on the frame of the image forming apparatus, wherein said coupling protrusion shaft and said projection are coaxial with an axis of said electrophotographic photosensitive drum, wherein rotation of said driven gear rotates the recessed shaft so that the rotational driving force thereof is transmitted from the driven gear to said electrophotographic photosensitive drum through engagement between the recessed portion and said projection;

a bearing supported by said cleaning frame, wherein said coupling protrusion shaft is fitted in said bearing;

a helical drum gear integral with said drum flange and meshing with said developing roller gear;

a cylindrical boss integral with said bearing and coaxial with and surrounding said coupling protrusion shaft to protect said coupling protrusion shaft when said process cartridge is mounted on and dismounted from the image forming apparatus; and a guard portion for covering said helical drum gear, wherein side surfaces, an upper surface, a lower surface and a front surface of said helical drum gear, in a process-cartridge-mounting direction facing corresponding directions when the process cartridge is mounted on the main body, are covered; and wherein the process cartridge is mounted to said main body of the image forming apparatus from a direction transverse to a longitudinal direction of said electrophotographic photosensitive drum.

14. A process cartridge according to claim 13, wherein said cartridge comprises plural guard portions, wherein said cleaning frame comprises a cover portion and side walls, wherein said guard portion is provided below the side walls suspended from both longitudinal ends of said cover portion, wherein said plural guard portions are connected to said side walls, and wherein said plural guard portions are also connected to front connection portions for connecting the side walls to side plates of a waste toner reservoir.

15. A process cartridge according to claim 13, wherein said cleaning frame further comprises front connection cover portion, wherein said guard portion is provided on said bearing and abuts against or is overlapped with said front connection cover portion.

* * * * *

UNITED STATES PATENT AND TRADEMARK OFFICE

CERTIFICATE OF CORRECTION

PATENT NO. : 5,930,562

DATED : July 27, 1999

INVENTOR(S): SHINYA NODA, ET AL.

It is certified that error appears in the above-identified patent and that said Letters Patent is hereby corrected as shown below:

COVER PAGE:
Insert: --[*] Notice: This patent issued on a continued prosecution application filed under 37 CFR 1.53(d), and is subject to the twenty-year patent term provisions of 35 U.S.C. 154(a)(2).

COLUMN 1:
Line 33, "apparatus" should read --apparatus,--.

COLUMN 4:
Line 52, "projection" should read --the projection--.

COLUMN 6:
Line 17, "with" should be deleted.

COLUMN 10:
Line 9, "flanges" should read --flange,--.
Line 31, "incudes" should read --includes--.

UNITED STATES PATENT AND TRADEMARK OFFICE

CERTIFICATE OF CORRECTION

PATENT NO. : 5,930,562

DATED : July 27, 1999

INVENTOR(S): SHINYA NODA, ET AL.

It is certified that error appears in the above-identified patent and that said Letters Patent is hereby corrected as shown below:

COLUMN 11:

Line 38, "removably" should read --removably be--; and

Line 53, "flanges," should read --flange,--.

Signed and Sealed this

Sixth Day of June, 2000

*Attest:*

Q. TODD DICKINSON

*Attesting Officer*

*Director of Patents and Trademarks*